US005732884A

United States Patent [19]

Jauner

[11] Patent Number: 5,732,884

[45] Date of Patent: Mar. 31, 1998

[54] SPRAY WITH A HANDLE AND A SHUT-OFF MEMBER WHICH CAN BE ACTUATED BY MEANS OF A HAND LEVER

[75] Inventor: Hansjorg Jauner, Wettingen, Switzerland

[73] Assignee: KWC AG, Unterkulm, Switzerland

[21] Appl. No.: 534,865

[22] Filed: Sep. 27, 1995

[30] Foreign Application Priority Data

Sep. 29, 1994 [CH] Switzerland ..... 02 947/94

[51] Int. Cl.[6] ..... B05B 1/14

[52] U.S. Cl. ..... 239/288.3; 239/530; 239/602; 239/DIG. 12; 137/219; 251/246

[58] Field of Search ..... 239/104, 288–288.5, 239/380, 381, 383, 525, 530, 553.5, 548, 552, 556, 557, 558, 576, 578, 601, 602, DIG. 12; 137/219; 251/34, 246

[56] References Cited

U.S. PATENT DOCUMENTS

| | | | |
|---|---|---|---|
| 2,623,790 | 12/1952 | Smith | 239/576 X |
| 3,420,449 | 1/1969 | Mincielli et al. | 239/602 X |
| 4,204,646 | 5/1980 | Shames et al. | 239/381 X |
| 4,607,795 | 8/1986 | Ettlinger et al. | 239/530 |
| 4,618,279 | 10/1986 | Gurevich et ak. | 401/36 |
| 5,100,055 | 3/1992 | Rokitenetz et al. | 239/436 X |

FOREIGN PATENT DOCUMENTS

| | | |
|---|---|---|
| 2755893 | 6/1979 | Germany . |
| 647 165 | 1/1985 | Switzerland . |
| 94/09910 | 5/1994 | WIPO . |

*Primary Examiner*—Lesley D. Morris

*Attorney, Agent, or Firm*—Jacobson, Price, Holman & Stern, PLLC

[57] ABSTRACT

The spray, serving, in particular, as a dishwashing spray, exhibits, as essential elements, a connection stub (12), a handle (10), a shut-off valve (14) and a spray head (16). The shut-off valve (14) can be actuated, by means of a hand lever (18), counter to the force of the spring (**14*j*). The handle (10), the shut-off valve (14) and the hand lever (18) are enclosed by an elastomeric covering (20) which is sealed towards the outside and provides the hand lever (18) with free play. Such a configuration is particularly hygienic since the covering (20**) can be easily washed and it does not exhibit any inaccessible gaps in which contaminants can be deposited.

11 Claims, 1 Drawing Sheet

SPRAY WITH A HANDLE AND A SHUT-OFF MEMBER WHICH CAN BE ACTUATED BY MEANS OF A HAND LEVER

The invention relates to a spray including an elongated tubular handle forming a water flow path provided with a longitudinally movable shut-off valve operated by a pivotal hand lever. The outlet end of the flow path includes a plurality of outlet openings associated with a pulsator to enhance the cleaning function of the spray. An elastomeric cover encloses and protects the components and enables easy cleaning to reduce bacteria growth with the flexibility and construction of bosses in the cover which are associated with the outlet openings reducing accumulation of lime deposits.

Such a spray, known from CH-PS647165 and provided with a pivotable hand lever, serves, in particular, as a dishwashing spray, for example in a catering kitchen. When the hand lever, which is under the force of a spring, is pressed down, the built-in shut-off valve is opened and, when the hand lever is released, is closed by spring force.

In practice, this known spray has proven ideal for efficient work in catering kitchens. However, the situation where contaminants collect in joints between the handle and the hand lever and where, furthermore, lime is deposited on the water outlet side is not ruled out. In addition, contaminants can provide a good breeding ground for bacteria, which can have grave consequences, in particular, in kitchens.

Although it is known, in order to prevent lime deposits on the water outlet side, to arrange bosses which project beyond the surface, such projecting bosses, being unprotected, are exposed to the risk of damage. However, damaged or broken-off bosses are not only useless, but the fracture locations can be favorable for the accumulation of bacteria.

The object of the invention is thus to provide a spray in which the accumulation of contaminants and/or lime deposits is prevented and in which the cleaning action effected by the spray jet is improved.

The object is achieved, according to the invention, by a spray including an elongated tubular handle forming a water flow path provided with a longitudinally movable shut-off valve operated by a pivotal hand lever. The outlet end of the flow path includes a plurality of outlet openings associated with a pulsator to enhance the cleaning function of the spray. An elastomeric cover encloses and protects the components and enables easy cleaning to reduce bacteria growth with the flexibility and construction of bosses in the cover associated with the outlet openings reducing accumulation of lime deposits.

The invention in accordance with the above objects ensures hygienic handling of the spray. The elastomeric covering can easily be kept clean and, due to the flexibility during handling, any lime deposits, of which there will hardly be any, on the covering crumble away automatically.

In contrast to a molded-in configuration, this invention permits prefabrication of the covering in order to ensure the freedom of movement of the hand lever. Furthermore, means for sealing the covering can be dimensioned such that, after the covering has been mounted, a sufficient sealing action is achieved by corresponding prestressing enhanced by coacting annular grooves and beads.

Lime deposits are prevented on the outlet side of the spray head by a flexible resilient boss associated with each of the outlet openings. The spray head includes a spray head which on the one hand, effects vibration of the bosses and thus promotes self-cleaning and, on the other hand, increases the cleaning action of the water jet directed with said spray onto dishes or other surfaces.

In order to seal the spray head towards the outside, the force transmission elements from the hand lever to the movable part of the shut-off valve eliminates sealing elements which act directly on the force transmission elements.

An exemplary embodiment of the invention is explained in more detail with reference to the drawing, in which.

Figures 1, 2, 3, 4:
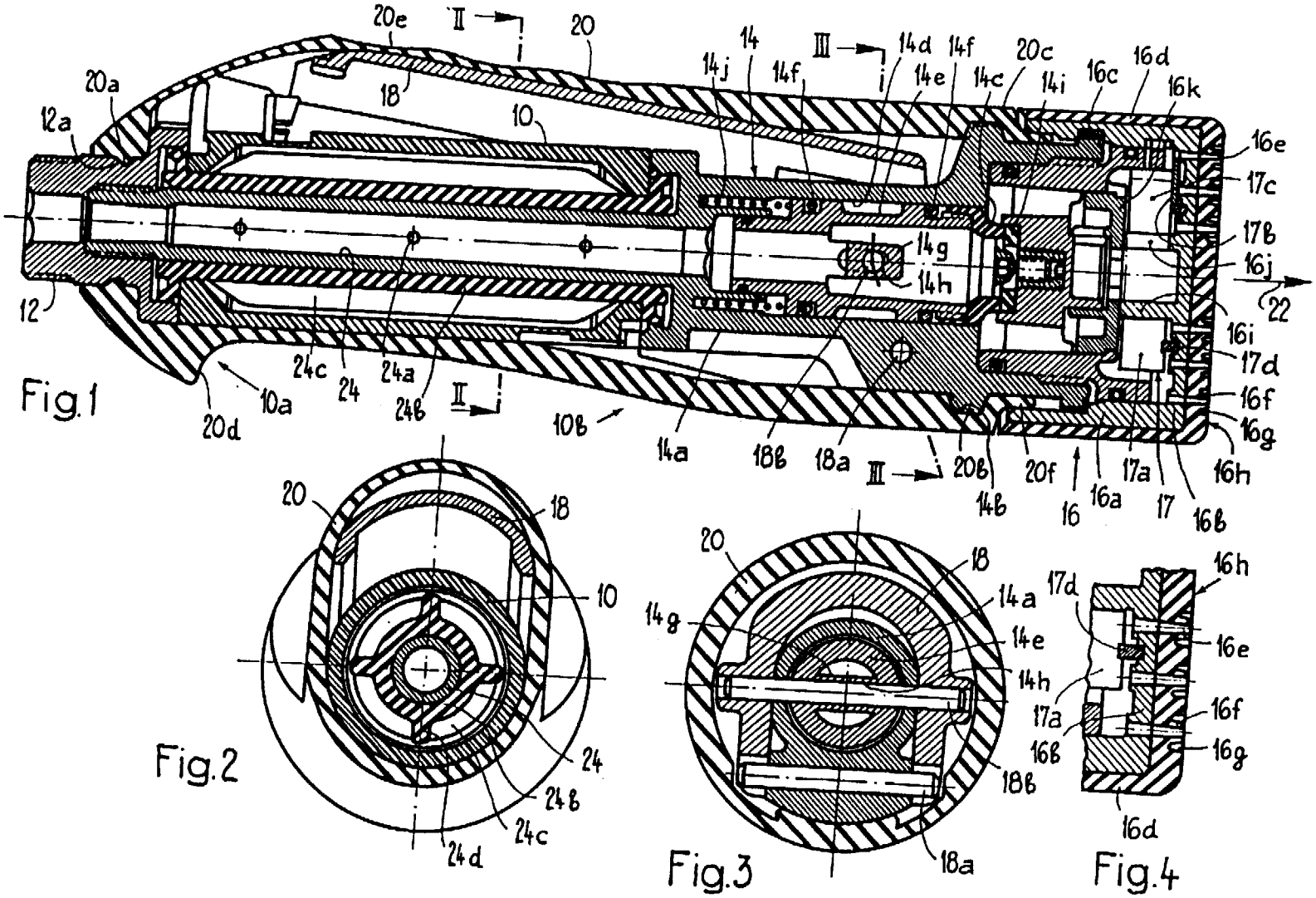
FIG. 1 shows a longitudinal section of a dishwashing spray.
FIG. 2 shows the dishwashing spray in a cross-section along line II—II according to FIG. 1.
FIG. 3 shows the dishwashing spray in a cross-section along line III—III according to FIG. 1.
FIG. 4 shows, on a larger scale, a detail from FIG. 1 at the bottom on the right-hand side.

According to FIG. 1, the dishwashing spray exhibits a tubular handle 10 which bears, at its inlet-side end 10*a*, a connection stub 12 and, at its outlet-side end 10*b*, a shut-off valve 14, as shut-off member, with an adjoining spray head 16. A hand lever 18 is mounted, such that it can be pivoted about a pivot pin 18*a*, on the housing 14*a* of the shut-off valve 14.

The handle 10, the hand lever 18 and part of the shut-off valve 14 are enclosed by an elastomeric covering 20 which is sealed towards the outside and provides the hand lever 18 with free play. For sealing purposes, the elastomeric covering 20 engages, at the inlet-side end 10*a*, with a bead 20*a*, under prestressing, into an annular groove 12*a* arranged on the circumference of the connection stub 12. At its outlet-side end 20*c*, the covering 20 exhibits, on its inner side, four clearances 20*b* which are distributed over the circumference and into which segment-like lugs 14*b* arranged on the valve housing 14*a* engage as rotation-prevention means. For sealing and fastening, the narrowed end 20*f* of the covering 20 is clamped in beneath the hood-like part 16*a*.

The covering 20 is ergonomically formed, in that it is adapted to the hand in a manner which aids holding. On the side remote from the hand lever 18, the covering 20, resting directly on the handle 10, exhibits a hollow 20*d* which is intended for the ball of the thumb. The covering 20 rests on the hand lever 18 without prestressing and exhibits depressions 20*e* around which the fingers are intended to grip.

The shut-off valve 14 exhibits an annular valve body 14*c* which is arranged on a carriage 14*e* which is guided such that it can be displaced in the longitudinal direction in a bore 14*d* in the valve housing 14*a*. The carriage 14*e* is in the form of a tube and further serves, in the longitudinal direction, as a through-passage. It is sealed with respect to the bore 14*d* by means of seals 14*f* at both ends. Approximately in the center between the two seals 14*f* there is arranged, on the carriage 14*e*, a transverse web 14*g* with a bore 14*h* into which there is pressed a slave pin 18*b* coupled to the hand lever 18. The space enclosing the carriage 14*e* between the two seals 14*f* is free of water, with the result that no further seal is necessary for the coupling with the hand lever 18 towards the outside.

The valve body 14*c* serves as a shut-off element and interacts with a rubber valve element 14*i* which is retained in a collar.

The hand lever 18 can be actuated counter to the force of a restoring spring 14*j* which is intended for closing the shut-off valve 14 and, at one end, acts on the carriage 14*e* and, at the other end, is supported on the valve housing 14*a*.

The spray head 16 is arranged in a hood-like part 16*a*, of which the outlet side is designed as a perforated spraying element 16b. The hood-like part 16a is connected to the valve housing 14a by means of a bayonet-type closure 16c. The hood-like part 16a is covered by an elastomeric cap 16d. Arranged in said cap 16d, on the end side, are outlet openings 16e which correspond with outlet openings of the perforated spraying element 16b and of which each is enclosed by a boss 16f extending in the outlet direction 22 (see also FIG. 4). Each of these bosses 16f is arranged in a sunken manner, and enclosed by an annular groove 16g, such that it is flush with the outer side 16h of the elastomeric cap 16d.

Furthermore, a pulsator 17 is arranged in the spray head 16, which pulsator exhibits an impeller 17a, which can be driven by the throughflow, and a sector-like covering disk 17b which is connected to the impeller in a rotationally fixed manner and covers and releases again the outlet openings in the perforated spraying element 16b as it rotates, with the result that the spray jet is discharged in a pulsating manner. The sector-like covering disk 17b circumferentially extends approximately over an angle of 180°. The impeller 17a exhibits, distributed uniformly over the circumference, a plurality of blades 17c which, in the region of the covering disk 17b, are fastened on the latter and, in the interrupted region, are fastened on an annular carrier 17d. The pulsator 17, comprising the parts 17a, 17b, 17c and 17d, is mounted, as a rotor, on a sleeve 16i which is integrally formed on the hood-like part 16a and exhibits, distributed over its circumference, nozzle-like through-passage openings 16j which are directed onto the blades 17c. In order to transmit a sufficient torque onto the blades 17c, the nozzle^_like openings are positioned obliquely in the direction of rotation.

Extending through the handle 10 is an inner tube 24, which produces a connection from the connection stub 12 to the shut-off valve 14. The inner tube 24 exhibits radial through-passages 24a and is enclosed by a compliant hose 24b. This arrangement, proposed in CH Patent Application no. 3630/93-0, serves to absorb water hammers when the shut-off valve 14 is closed, in that the hose 24b expands into a cavity 24c which encloses it.

It can be seen from FIG. 2 that the hose 24b is held in a centered manner in the handle 10 by means of webs 24d. It can further be seen from FIG. 2 that the hand lever 18 engages over the handle 10 in a U-shaped manner in cross-section, and that the elastomeric covering 20 jointly encloses the handle 10 and the hand lever 18, but does not impair the freedom of movement of the hand lever 18.

FIG. 3 shows the mounting of the hand lever 18 on the pivot pin 18a arranged in the valve housing 14a. The hand lever 18 is coupled to the carriage 14e via the slave pin 18b. The slave pin 18b is preferably pressed in the bore 14h of the transverse web 14g. In order to transmit the pivot movement of the hand lever 18 into the linear movement of the carriage 14e, slots are arranged both in the valve housing 14a and in the hand lever 18, the slave pin 18b extending through said slots.

A quantity-limiting ring 16k is arranged in the spray head 16, upstream of the pulsator 17 in the flow direction. Said ring, serving for presetting purposes, exhibits radially arranged windows which, depending on the setting, coincide more or less with stationary windows. For a latching-type setting in the circumferential direction, said ring 16k contains a hexagon socket which is accessible from the front after the hood-like part 16a has been removed.

The water fed via the connection stub 12 flows through the inner tube 24 and the carriage 14e of the shut-off valve 14 as far as the rubber valve element 14i which is closed by the valve body 14c. By pressing down the hand lever 18, the carriage 14e is moved to the left, in the depicted configuration, and the valve body 14c is thereby raised from the rubber valve element 14i. The water flows outwards, through the shut-off valve 14 which has thereby been opened, around the collar holding the rubber valve element 14i, through the windows of the quantity-limiting ring 16k, past the pulsator 17 and emerges out of the outlet openings 16e in the arrow direction 22 as a pulsating spray jet.

As has already been explained, FIG. 4 shows a detail according to FIG. 1 at the bottom on the right-hand side illustrating in more detail the specific construction of the outlet openings 16e and bosses 16f in cap 16d.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A spray with a tubular handle which bears, at an inlet-side end, connection means for a feed line and, at an outlet-side end, a spray head, with a shut-off member which is fitted on or in the handle and can be actuated, by means of a hand lever, counter to the force of a restoring spring intended for closure purposes, wherein at least the handle and the hand lever are enclosed by an elastomeric covering which is sealed towards the outside, the covering having an ergonomically formed shape adapted to a human hand and having a wall of variable thickness, and the covering providing the hand lever with free play.

2. A spray as claimed in claim 1, wherein the thickness of the wall of the covering is smaller at the hand lever than at its ends.

3. The spray as claimed in claim 2, wherein the sealing means exhibit either an annular bead or an annular groove on the inner side of the covering, wherein a counterpart in the form of an annular protrusion or an annular groove is formed, in the manner of a groove/spline connection, on the handle or on each of the parts connected thereto.

4. The spray as claimed in claim 1, wherein, at its outlet-side end, the covering is clamped in a sealing manner between a hood-like part of the spray head and the end of the housing of the shut-off member.

5. The spray as claimed in claim 1, wherein the spray head exhibits an elastomeric wall or an elastomeric cap with outlet openings, of which each is enclosed by a boss extending in the outlet direction, and wherein each of the bosses is enclosed by an annular groove such that the highest elevation of the bosses is at least approximately flush with the end side of the wall or of the cap.

6. The spray as claimed in claim 1, wherein the shut-off member exhibits a valve body which is designed in the manner of a ring and is arranged on a carriage which is guided such that it can be displaced in the longitudinal direction in the handle or in a housing of the shut-off member, is designed, as a through-passage, in the form of a tube and exhibits seals, between which seals there is arranged, on the carriage, a transverse web which extends through the through-passage and has a bore into which there engages, or is pressed, a slave pin coupled to the hand lever.

7. A spray with a tubular handle which bears, at an inlet-side end, connection means for a feed line and, at an outlet-side end, a spray head, with a shut-off member which is fitted on or in the handle, exhibits a valve body and can be actuated, by means of a hand lever, counter to the force of a restoring spring intended for closure purposes, wherein the valve body is designed in the form of a ring and is arranged on a carriage which is guided such that it can be displaced in the longitudinal direction in the handle or in the housing of the shut-off member, is designed, as a through-passage, in the form of a tube and exhibits seals, between which seals there is arranged, on the carriage, a transverse web with a bore into which there engages, or is pressed, a slave pin coupled to the hand lever.

8. A spray with a tubular handle which bears, at an inlet-side end, connection means for a feed line and, at an outlet-side end, a spray head which, at least on its outlet side, provided with outlet openings, exhibits an elastomeric wall or an elastomeric cap, the wall or the cap exhibiting bosses which enclose the outlet openings, wherein each of the bosses is enclosed by an annular groove such that the highest elevation of the bosses is at least virtually flush with the end side of the elastomeric wall or of the elastomeric cap.

9. A spray with a tubular handle which bears, at an inlet-side end, connection means for a feed line and, at an outlet-side end, a spray head, with a shut-off member which is fitted on or in the handle and can be actuated, by means of a hand lever, counter to the force of a restoring spring intended for closure purposes, wherein at least the handle and the hand lever are enclosed by an elastomeric covering which is sealed towards the outside and provides the hand lever with free play, and wherein, at its outlet-side end, the covering is clamped in a sealing manner between a hood-like part of the spray head and the end of the housing of the shut-off member.

10. A spray with a tubular handle which bears, at an inlet-side end, connection means for a feed line and, at an outlet-side end, a spray head, with a shut-off member which is fitted on or in the handle and can be actuated, by means of a hand lever, counter to the force of a restoring spring intended for closure purposes, wherein at least the handle and the hand lever are enclosed by an elastomeric covering which is sealed towards the outside and provides the hand lever with free play, wherein the spray head exhibits an elastomeric wall or an elastomeric cap with outlet openings, of which each is enclosed by a boss extending in the outlet direction, and wherein each of the bosses is enclosed by an annular groove such that the highest elevation of the bosses is at least approximately flush with an end side of the wall or of the cap.

11. A spray with a tubular handle which bears, at an inlet-side end, connection means for a feed line and, at an outlet-side end, a spray head, with a shut-off member which is fitted on or in the handle and can be actuated, by means of a hand lever, counter to the force of a restoring spring intended for closure purposes, wherein at least the handle and the hand lever are enclosed by an elastomeric covering which is sealed towards the outside and provides the hand lever with free play, and wherein the shut-off member exhibits a valve body which is designed in the manner of a ring and is arranged on a carriage which is guided such that it can be displaced in the longitudinal direction in the handle or in a housing of the shut-off member, is designed, as a through-passage, in the form of a tube and exhibits seals, between which seals there is arranged, on the carriage, a transverse web which extends through the through-passage and has a bore into which there engages, or is pressed, a slave pin coupled to the hand lever.

* * * * *